US007102606B2

(12) United States Patent
Miyajima et al.

(10) Patent No.: US 7,102,606 B2
(45) Date of Patent: Sep. 5, 2006

(54) DISPLAY DEVICE OF ACTIVE MATRIX TYPE

(75) Inventors: Yasushi Miyajima, Gifu (JP); Masayuki Koga, Anpachi-gun (JP)

(73) Assignee: Sanyo Electric Co., Ltd. (JP)

( * ) Notice: Subject to any disclaimer, the term of this patent is extended or adjusted under 35 U.S.C. 154(b) by 0 days.

(21) Appl. No.: 09/820,262

(22) Filed: Mar. 28, 2001

(65) Prior Publication Data

US 2001/0045930 A1 Nov. 29, 2001

(30) Foreign Application Priority Data

Mar. 28, 2000 (JP) ..... 2000-087770

(51) Int. Cl.
*G09G 3/36* (2006.01)

(52) U.S. Cl. ..... 345/92; 345/98; 345/99

(58) Field of Classification Search ..... 345/92, 345/100, 98, 87, 211, 213, 99, 76, 77, 89, 345/214; 349/42, 43
See application file for complete search history.

(56) References Cited

U.S. PATENT DOCUMENTS 5,929,489 A * 7/1999 Deane ..... 257/347
6,359,607 B1 3/2002 Yanagi et al.
6,421,038 B1 * 7/2002 Lee ..... 345/98

FOREIGN PATENT DOCUMENTS

EP 0 574 920 A2 * 12/1993
EP 0 574 920 12/1993
GB 2 341 714 3/2000
JP 06 110035 4/1994
JP 09 258174 3/1997

OTHER PUBLICATIONS

H. Taub et al., "Digital Integrated Electronics", 1977, McGraw–Hill, Tokyo Japan XP002183048, p. 257–p. 277.
Copy of Office Action dated Jan. 3, 2005 for related European Patent Application No. 01302925.1.
Copy of Japanese Patent Laid–Open Publication No. Hei 11–281957 and English abstract.

* cited by examiner

*Primary Examiner*—Xiao Wu
(74) *Attorney, Agent, or Firm*—Cantor Colburn LLP

(57) ABSTRACT

When a gate voltage having a rectangular-shaped pulse is supplied, the voltage of a pixel electrode is pulled down and fluctuated by a fall of the gate voltage due to a parasitic capacitor formed between a gate line and the pixel electrode, i.e. a so-called drop voltage is generated. As the drop voltage depends on a time constant of a change in the gate voltage, it can be diminished by smoothing the falling edge of the gate voltage. This is achieved by, for example, providing a current discharging transistor of a gate driver 8 with a small channel width to decrease the maximum current value. By utilizing such a gate voltage, a liquid crystal display device with a small drop voltage can be provided, even when the capacitance of the parasitic capacitor is great.

18 Claims, 3 Drawing Sheets

DISPLAY DEVICE OF ACTIVE MATRIX TYPE

BACKGROUND OF THE INVENTION

1. Field of the Invention

The present invention relates to a display device of an active matrix type provided with a plurality of pixel electrodes arranged in a matrix and each connected to a thin film transistor (hereinafter referred to as a "TFT") as a switching element, and more particularly to a liquid crystal display (LCD) having an improved gate line driver.

2. Description of the Related Art

FIG. 1 shows an equivalent circuit diagram for one pixel in an LCD. A pixel TFT 5 connected to a gate line 2 and a data line 4 is connected to a pixel electrode 6. The pixel electrode 6 forms a capacitor $C_{LC}$ with an opposite electrode Vcom with liquid crystal 11 interposed therebetween. A storage capacitor $C_{SC}$ is provided in parallel to the liquid crystal capacitor $C_{LC}$ to maintain a voltage applied to the pixel electrode 6. While it is intended that the circuit have the above-described configuration, a parasitic capacitor $C_{GS}$ is generated between the gate and the source (the pixel electrode 6) of the TFT and increase in capacitance of the parasitic capacitor $C_{GS}$ results in problems, such as fluctuation in potential of the pixel electrode 6 due to the effects of a gate voltage applied to the gate line 2. In conventional devices, the effects of the parasitic capacitor $C_{GS}$ are reduced by providing a storage capacitor $C_{SC}$ with sufficient capacitance to account for that of the parasitic capacitor $C_{GS}$.

In recent years, LCDs have come to be widely used for display devices in portable electronic devices, such as, for example, for viewfinders in digital still cameras and digital video cameras. LCDs for such portable devices must be made fine with a reduced display size while maintaining the number of pixels.

When a display size is reduced, the area of the pixel electrode is reduced, as is the electrode for forming the storage capacitor $C_{SC}$. As a result, the capacitances of the liquid crystal capacitor $C_{LC}$ and the storage capacitor $C_{SC}$ are decreased. On the other hand, because the processible minimum line width is fixed, it is difficult to reduce the capacitance of the parasitic capacitor $C_{GS}$ beyond a certain level. Thus, when the LCD is made fine, the parasitic capacitor $C_{GS}$ has a relatively greater capacitance as compared to the liquid crystal capacitor $C_{LC}$ and the storage capacitor $C_{SC}$.

Such an increase in capacitance of the parasitic capacitor $C_{GS}$ gives rise to an increase of a so-called drop voltage $\Delta V$, i.e. the potential of the pixel electrode fluctuates because it is pulled down by a fall of the gate voltage. When the drop voltage $\Delta V$ is increased, various problems occur, such as generation of a difference in luminance between columns when liquid crystal is driven by an alternating voltage, and deviation of a central value Vc of a voltage applied to the pixel electrode from the potential Vcom of the opposite electrode.

SUMMARY OF THE INVENTION

Therefore, an object of the present invention is to provide an LCD capable of avoiding an increase of the drop voltage $\Delta V$ even when the capacitance of the parasitic capacitor $C_{GS}$ becomes greater as compared to the liquid crystal capacitor $C_{LC}$ and the storage capacitor $C_{SC}$, to thereby maintain the display quality of a finely manufactured LCD.

The present invention has been conceived in view of the above-described problems, and an active matrix type display device according to one aspect of the invention includes a plurality of gate lines; a plurality of data lines crossing said plurality of gate lines; a plurality of pixel electrodes; a thin film transistor disposed at each intersection between said plurality of gate lines and said plurality of data lines, and including a gate electrode and an active region, said gate electrode being connected to one of said plurality of gate lines, and said active region having a first region connected to one of said plurality of data lines, and a second region connected to a corresponding one of said plurality of pixel electrodes; and a gate line driver for sequentially applying a gate selection signal with a pulse-shaped voltage waveform to a selected one of said plurality of gate lines, wherein said gate line driver causes a falling edge of said gate selection signal with said pulse-shaped voltage waveform to be smoother, or less sharp, than a rising edge thereof.

Alternatively, according to the present invention, said gate line driver causes a falling time of said gate selection signal with said pulse-shaped voltage waveform to be longer than a corresponding rising time.

As described above, according to the present invention, a gate voltage having a less sharp falling edge is applied, whereby a drop voltage $\Delta V$ resulting from fluctuation of the gate voltage is suppressed to only a small value. As a result, an active matrix type liquid crystal display device with a high display quality can be provided.

According to another aspect of the present invention, in an active matrix type display device as described above, said gate selection signal requires at least a time period of t/2 to fall, where t is a time period from the time a first gate line assumes an unselected state to the time a subsequent second gate line assumes a selected state.

According to still another aspect of the present invention, in an active matrix type display device as above, said gate selection signal falls over a time at least ten times that required for rise.

By thus providing a sufficiently long period of time for the gate selection signal to fall, the drop voltage $\Delta V$ can be suppressed to a sufficiently low value.

According to a further aspect of the present invention, in an active matrix type display device as above, said gate line driver includes a gate buffer provided at a final stage and connected to a corresponding one of said plurality of gate lines. The gate buffer includes a transistor having first and second regions of an active layer respectively connected to the ground and said corresponding gate line. Further, the condition, $2.5(R1+R2)*(C1+C2)<t<5(R1+R2)*(C1+C2)$, is satisfied, where R1 represents a total resistance of said gate line and the gate electrodes of the thin film transistors connected to said gate line in a pixel region, C1 represents a total capacitance of capacitors connected to said gate line in the pixel region and having said gate line as one electrode, R2 represents a channel resistance of the transistor in said gate buffer, C2 represents a capacitance of a capacitor formed by said active layer of the transistor in said gate buffer and the gate electrode of said transistor, and t represents a flyback period within a horizontal scanning period.

According to a further aspect of the present invention, in the above active matrix type display device, a channel length L and a channel width W of the transistor in said gate buffer satisfy a condition of $W/L<1$.

According to a further aspect of the present invention, in an active matrix type display device as above, said gate line driver includes a gate buffer provided at a final stage and connected to a corresponding one of said plurality of gate lines, said gate buffer including a current supplying transistor having first and second regions of an active layer connected between a power source and said corresponding gate line and a current discharging transistor having first and second regions of an active layer respectively connected to the ground and said corresponding gate line, and the ratio (channel width W)/(channel length L) of said current supplying transistor is different from the ratio (channel width W)/(channel length L) of said current discharging transistor.

According to a further aspect of the present invention, in an active matrix type display device as above, the channel length L and the channel width W of the current discharging transistor in said gate buffer satisfy the condition that W/L<1.

According to a further aspect of the present invention, in an active matrix type display device as above, the condition that the ratio of (the ratio W/L of said current supplying transistor)/(the ratio W/L of said current discharging transistor) is greater than 1 is satisfied.

According to a further aspect of the present invention, in an active matrix type display device as above, a condition that the ratio of (the ratio W/L of said current supplying transistor)/(the ratio W/L of said current discharging transistor) is greater than 5 is satisfied.

By thus designing respective circuit elements to satisfy the above conditions, it can be ensured that the gate voltage will fall within a predetermined time, and the drop voltage ΔV can be suppressed.

Further, as the ratio W/L of the transistor in the gate buffer, especially the current discharging transistor, is smaller than 1, the maximum allowable amount of current for this transistor can be reduced and the gate voltage (gate selection signal) can be provided with a blunted falling edge.

DESCRIPTION OF THE PREFERRED EMBODIMENTS

Preferred embodiments of the present invention will next be described.

Figure 1:
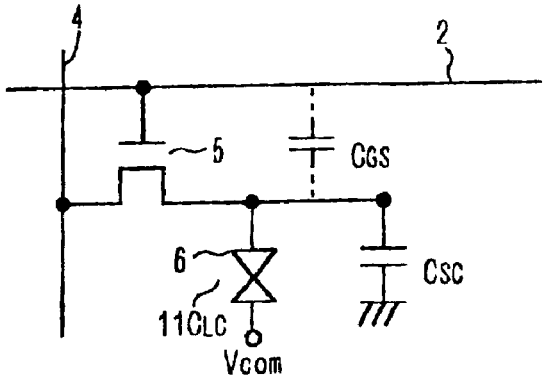
FIG. 1 is an equivalent circuit diagram of one pixel of a liquid crystal display device.
Figure 2:
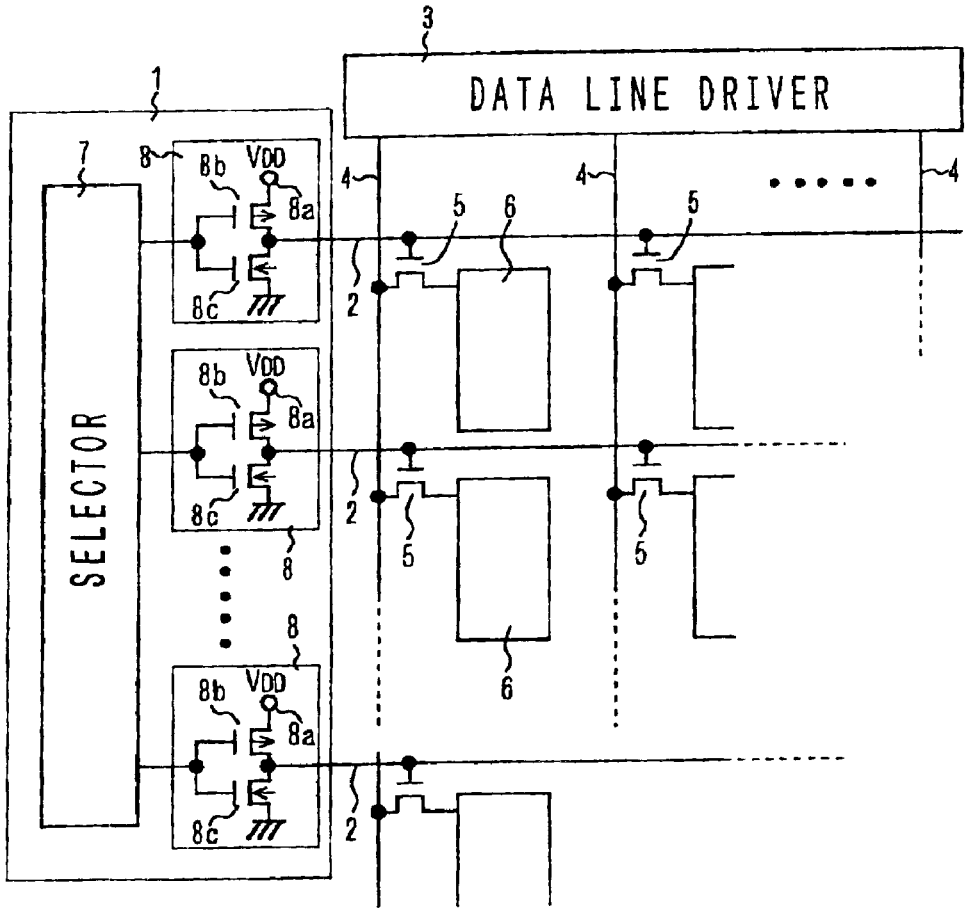
FIG. 2 is a plan view illustrating a liquid crystal display device according to the present invention.

FIG. 2 is a plan view showing an active matrix LCD according to the present invention. A plurality of gate lines 2 extending in a row direction are connected to a gate line driver 1, while a plurality of data lines 4 extending in a column direction are connected to a data line driver 3. A pixel electrode 6 is connected to an intersection between the gate line 2 and the data line 4 through a pixel TFT 5.

The gate line driver 1 includes a selector 7 for selecting one of a plurality of gate buffers 8, each applying a gate voltage to the gate line 2. The selector 7 selects one of the plurality of gate buffers 8, and outputs a signal "High" to the selected buffer 8 and a signal "Low" to the rest of the buffers 8.

Each of the gate buffers 8 includes a p-channel thin film transistor (hereinafter referred to as a "p-ch transistor") 8*b*, and an n-channel thin film transistor (hereinafter referred to as an "n-ch transistor") 8*c*. These transistors form a CMOS configuration, and are connected in series between a power source 8*a* and the ground. The transistors 8*b* and 8*c* have a gate electrode receiving an output from the selector 7, and a node between the CMOS transistors 8*b* and 8*c* is connected to the corresponding gate line 2. When one of the outputs of the selector 7 is rendered "Low", in the gate buffer 8 receiving that output, the p-ch transistor 8*b* functioning as a current supplying (source) transistor is turned on while the n-ch transistor 8*c* functioning as a current discharging (sink) transistor is turned off, so that a power source voltage VDD is supplied from the power source to the gate line 2 through the p-ch transistor 8*b*. As a result, all the pixel TFTs 5 connected to that gate line 2 are turned on, allowing data to be written in the pixel electrodes 6.

The data line driver 3 is connected to the plurality of data lines 4, and applies a data voltage corresponding to a displayed video image to each of the data lines 4. As the pixel TFT 5 connected to the selected gate line 2 has an open gate, the data voltage applied to the data line 4 is written in the pixel electrode 6 through the pixel TFT 5. The image is then displayed by changing alignment of the liquid crystal corresponding to the pixel electrodes 6.

After a predetermined period (specifically, one horizontal scanning period) has elapsed, the selector 7 selects another one of the gate buffers 8 for selecting the gate line 2 in the next row. In other words, the selector 7 outputs "High" to the gate buffer 8 which has been selected up to that moment, thereby turning off the p-ch transistor, and, instead, turning on the n-ch transistor. As a result, the corresponding gate line 2 is dropped to a ground potential, thereby turning off the gate of each pixel TFT 5.

Figure 3A:
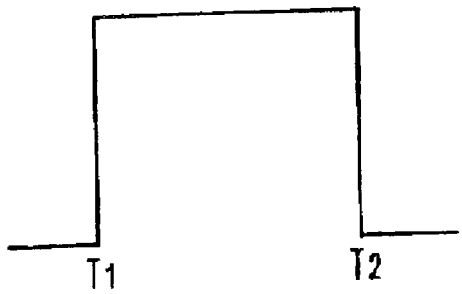
FIGS. 3(*a*), 3(*b*), and 3(*c*) show pulse waveforms supplied to a gate line.
Figure 3B:
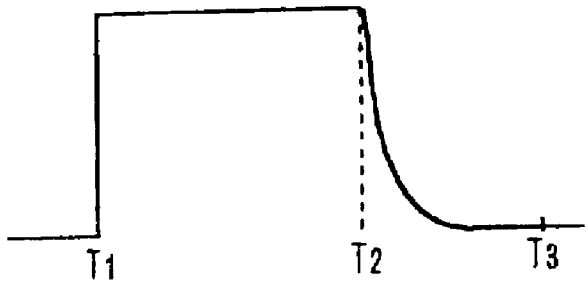
Figure 3C:
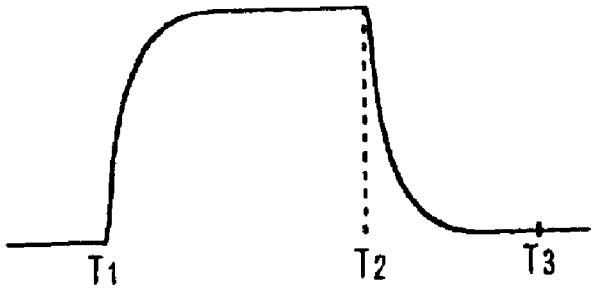

The characteristic feature of this embodiment lies in the pulse waveform of the gate voltage. FIG. 3(*a*) shows a pulse waveform of a gate voltage that has conventionally been regarded as an ideal waveform. This pulse waveform is a rectangular waveform rising vertically at a first time point T1 and falling vertically at a second time point T2. On the other hand, the present embodiment utilizes a gate voltage having a characteristic pulse waveform in FIG. 3(*b*) in which edge sharpness is reduced. That is, as shown in FIG. 3(*b*), the waveform in which the voltage rises at the first time T1, begins to fall at the second time T2, and completes falling at a third time T3 is ideal in this embodiment.

When a gate voltage having a pulse in such a waveform is supplied, reduction in the drop voltage ΔV can be achieved. Because the drop voltage ΔV is a function of a time constant of a voltage change, the drop voltage ΔV is reduced when the gate voltage gradually changes, as in the waveforms in FIGS. 3(*b*) and 3(*c*).

Figure 4:
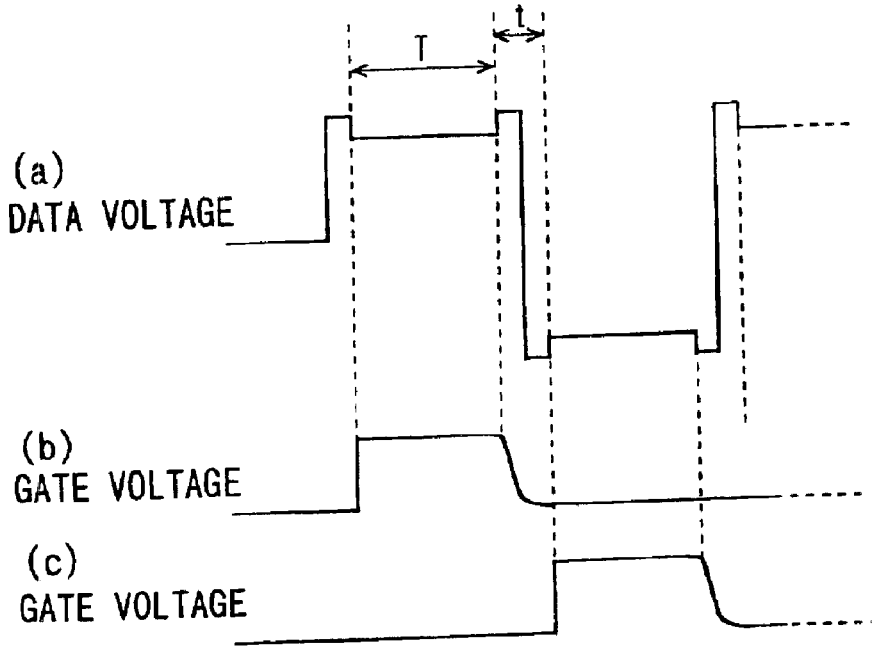
FIG. 4 shows timing charts of voltages applied to a data line and the gate line.

Next, a method of reducing the sharpness of the falling edge of the gate voltage will be described. FIG. 4 shows timing charts of a data voltage (a) applied to a given data line in driving the LCD by an alternating voltage, a gate voltage (b) applied to a given gate line, and a gate voltage (c) applied to a gate line located in the next row from the gate line related to the voltage (b). A time period T during which the gate voltage is ON is a so-called writing period in which the TFT 5 is turned on causing the data voltage to be applied to the pixel electrode 6 and the voltage is boosted. After a flyback period t provided in each horizontal scanning period has elapsed, data is written in the pixel electrode 6 in the next row. The gate voltage falls during the flyback period t, and the gate voltage for the next row rises in synchronism with the next writing period T. When the LCD is driven by the voltage having a pulse in the waveform in FIG. 3(*a*) (which actually has a slightly blunt edge), a time period required for the gate voltage to fall is approximately t/100, where t is the flyback period. In contrast, the gate voltage in this application gradually falls in a period of approximately t/2.

As the time required for the gate voltage to rise is approximately t/100, a time 50 times as long as this rising time is required for the gate voltage to fall.

Naturally, the voltage ΔV can further be reduced if the gate voltage falls in a period greater than t/2. If the time period required for the fall exceeds the period t, however, application of the data voltage to the pixel TFT 5 in the next row is started, hindering image display operation. Therefore, the time period required for the fall must be shorter than the period t. Further, considering variation in the falling time period among the respective pixel TFTs 5 resulting from variation of the pixel TFTs 5 generated during fabrication, the voltage is preferably set to fall in a period of t/2.

Generally, a voltage drop observed when an electric circuit releases electric charges is proportional to $e^{-(t/RC)}$, where R is the resistance of the circuit and C is the capacitance thereof. Regarding the voltage drop of the gate line 2:

R=(resistance of the selected gate line 2)+(overall resistance of the gate electrodes of all the pixel TFTs 5 connected to the selected gate line 2)+(channel resistance of the n-ch transistor 8*c* of the gate buffer 8); and C=(capacitance of the capacitor formed by the selected gate line 2 and another electrode and the like)+(overall capacitance of the capacitors formed by the gate electrodes of all the pixel TFTs 5 connected to that gate line 2)+(capacitance of the gate-source and gate-drain capacitors of the n-ch transistor 8*c* of the gate buffer 8).

Assuming that the gate of the pixel TFT 5 is closed (i.e. the TFT is turned off) when the gate voltage falls to one tenth of the applied voltage or lower, the condition for the gate to close within the flyback period is:

$$t<5(R1+R2)\cdot(C1+C2),$$

where

R1=the total of the resistance of the gate line and the overall resistance of the gate electrodes of the pixel TFTs connected thereto;

C1=the total of the capacitances of the capacitors formed by the gate line and the data line, the gate line and the opposite electrode, and an active layer of the thin film transistor connected to the pixel electrode and the gate electrode;

R2=channel resistance of the n-ch transistor 8*c* of the gate buffer;

C2=capacitance of the capacitor formed by the active layer of the thin film transistor of the gate buffer and the gate electrode; and t=time period from the time application of the voltage to the pixel electrode is ended to the time application of the voltage to the electrode in the next row is started: horizontal flyback period.

The flyback period t is determined by the driving frequency and the number of pixels of the LCD, and the values R1 and C1 are determined by the number of pixels and size of the LCD. By properly designing the n-ch transistor 8*c* of the gate buffer 8, the values R2 and C2 can be adjusted to satisfy the condition defined by the above expression. Further, the gate voltage can fall bluntly within a predetermined period by designing the n-ch transistor 8*c* to satisfy the following condition:

$$2.5(R1+R2)\cdot(C1+C2)<t<5(R1+R2)\cdot(C1+C2)$$

The time required for the gate voltage to fall is described as the flyback period t above. However, when, for example, the data line 4 is precharged to a predetermined voltage before the data voltage is applied, the time given as the gate voltage falling period is reduced from the above flyback period. In such a case, the flyback period t used in the above description should be replaced with the period from the time application of the data voltage is ended to the time precharging is started. In other words, the voltage of the pixel TFT 5 must fall completely before precharging is started, and the gate buffer must be designed so that the voltage gradually falls within this time period.

A specific method of applying a gate voltage having a blunted waveform will next be described. Referring to FIG. 2, when the output of the selector 7 is rendered "L", the gate of the transistor 8*b* is turned on, whereby a selection signal (gate voltage) is applied to the gate line 2 from the power source 8*a* through the transistor 8*b*, and the gate voltage rises at the selected gate line 2. For causing the gate voltage to fall, the output of the selector 7 is rendered "H", turning on the transistor 8*c*, through which the electric charges accumulated at the gate line 2 are released. At this time, the maximum current discharged from the transistor 8*c* is set to a small value, thereby setting the amount of time required to completely release the electric charges to a value such that the sharpness of the falling edge of the gate voltage can be reduced. Thus, in the present embodiment, bluntness of the gate voltage is adjusted by setting the maximum current in the transistor 8*c*.

Figure 5:
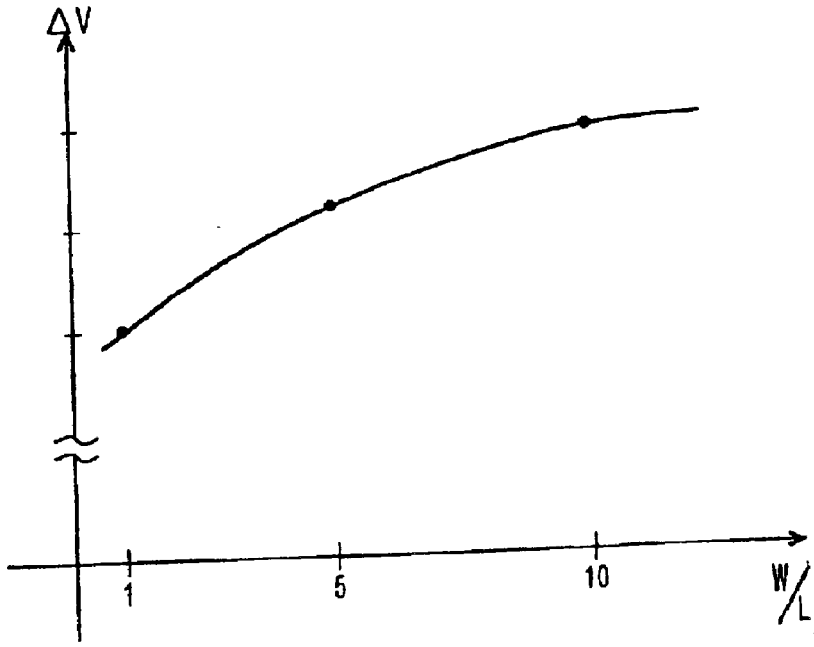
FIG. 5 shows a change in a voltage ΔV with the ratio between vertical and horizontal dimensions of a gate buffer transistor.

The maximum amount of current in a transistor is generally smaller for a greater gate length L and a smaller gate width W. Therefore, the maximum amount of current in a transistor is reduced as the ratio W/L between the gate length and the gate width is made smaller. FIG. 5 shows variation of the voltage ΔV with change in the ratio W/L of the n-ch transistor while the ratio W/L of the p-ch transistor is maintained. Although the value ΔV is changed by various factors, such as the size of the LCD and thickness of films, the change shown in FIG. 5 is obtained when all these parameters are fixed. It can be seen from the figure that the drop voltage ΔV decreases with a decrease in the ratio W/L of the n-ch transistors, i.e. it decreases as the width becomes smaller as compared to the length.

As illustrated in FIG. 2, the gate buffer is configured by combining the p-ch transistor and the n-ch transistor. The present invention is characterized in the smoother, less sharp falling edge of the gate voltage. For the rise of the gate voltage, as a longer time period is secured for application of the data voltage to the gate electrode if the voltage rises earlier, the pulse waveform in FIG. 3(*b*) is the most ideal waveform. The gate voltage is caused to rise by applying the power source voltage VDD to each of the gate lines 2 through the switched-on p-ch transistor 8*b*, and is caused to fall by connecting the gate line 2 to the ground through the turned-on n-ch transistor 8*c* for discharge. Therefore, the pulse waveform in FIG. 3(*b*) can be achieved by setting a greater value for the maximum allowable current in the p-ch transistor (source transistor) 8*b*, and by setting the maximum allowable current in the n-ch transistor (sink transistor) 8*c* smaller than the value for the above source transistor 8*b*. For such a setting, the ratio W/L of the p-ch transistor of the gate buffer is significantly different from that of the n-ch transistor. For example, the two W/L ratios are set as follows:

p-ch transistor's W/L ratio:n-ch transistor's W/L ratio= 10:1

It should be noted, however, that if sufficient time is secured to write data in the pixel electrode, the gate voltage may have a smoothed rising edge, as in the waveform in FIG. 3(*c*).

As an alternative method of smoothing the edge of the gate voltage, a resistor or a capacitor may be disposed between the gate buffer 8 and the gate line 2. With such a configuration, however, the sharpness of the rising edge of the gate voltage is also smoothed, as in the waveform shown in FIG. 3(*c*). Although such a waveform may create no problem when a sufficiently long writing period can be provided, the entire pulse is delayed when the edge is smoothed using resistors or capacitors.

While the present invention can be implemented in a variety of LCDs regardless of their size, the advantages are more prominent in a small-sized LCD, as will be described. As the gate line 2 has a predetermined resistance, the gate voltage is provided with different degrees of sharpness between the TFT 5 located closer to the gate driver 8 and the TFT 5 farther from the gate driver 8, and a delay of the selection signal becomes greater as the TFT 5 is located farther from the driver 8. Such a difference is more prominent in a larger LCD because the gate line 2 is longer. On the other hand, the gate line 2 is short in a small-sized LCD, such as a 2-inch or smaller LCD or a 0.55 inch or smaller LCD used for viewfinders and the like, and therefore the delay caused by resistance of the gate line 2 does not normally lead to any significant problems. On the other hand, the problem of the relatively greater capacitance of the parasitic capacitor is especially conspicuous in small-sized LCDs. Consequently, the advantages of the present invention are most effective when the invention is applied to small-sized LCDs.

What is claimed is:

1. An active matrix type display device comprising:

a plurality of gate lines;

a plurality of data lines crossing said plurality of gate lines;

a plurality of pixel electrodes;

a thin film transistor disposed at each intersection between said plurality of gate lines and said plurality of data lines, and including a gate electrode and an active region, said gate electrode being connected to one of said plurality of gate lines, and said active region having a first region connected to one of said plurality of data lines and a second region connected to a corresponding one of said plurality of pixel electrodes; and a gate line driver for sequentially applying a gate selection signal with a pulse- shaped voltage waveform to a selected one of said plurality of gate lines; wherein said gate line driver causes a falling edge of said gate selection signal with said pulse-shaped voltage waveform to be smoother than a rising edge thereof;

wherein said gate selection signal requires at least a time t/2 and shorter than t to fall, where t is the time from when a first gate line assumes an unselected state to when subsequent second gate line assumed a selected state.

2. An active matrix type display device comprising:

a plurality of gate lines;

a plurality of data lines crossing said plurality of gate lines;

a plurality of pixel electrodes;

a thin film transistor disposed at each intersection between said plurality of gate lines and said plurality of data lines, and including a gate electrode and an active region, said gate electrode being connected to one of said plurality of gate lines, and said active region having a first region connected to one of said plurality of data lines and a second region connected to a corresponding one of said plurality of pixel electrodes; and a gate line driver for sequentially applying a gate selection signal with a pulse- shaped voltage waveform to a selected one of said plurality of gate lines; wherein said gate line driver causes a falling edge of said gate selection signal with said pulse-shaped voltage waveform to be smoother than a rising edge thereof;

wherein said gate line driver includes a gate buffer provided at a final stage and connected to a corresponding one of said plurality of gate lines, said gate buffer includes a transistor having first and second regions of an active layer respectively connected to the ground and to said corresponding gate line, and the condition, $2.5(R1+R2)*(C1+C2)<t<5(R1+R2)*(C1+C2)$, is satisfied, wherein R1 represents a total resistance of said gate line and the gate electrodes of the thin film transistors connected to said gate line in a pixel region, C1 represents a total capacitance of capacitors connected to said gate line in the pixel region and having said gate line as one electrode, R2 represents a channel resistance of the transistor in said gate buffer, C2 represents a capacitance of a capacitor formed by said active layer of the transistor in said gate buffer and the gate electrode of said transistor, and t represents a flyback period in a horizontal scanning period.

3. The active matrix type display device according to claim 2, wherein a channel length L and a channel width W of the transistor in said gate buffer satisfy the condition $W/L<1$.

4. An active matrix type display device comprising:

a plurality of gate lines;

a plurality of data lines crossing said plurality of gate lines;

a plurality of pixel electrodes;

a thin film transistor disposed at each intersection between said plurality of gate lines and said plurality of data lines, and including a gate electrode and an active region, said gate electrode being connected to one of said plurality of gate lines, and said active region having a first region connected to one of said plurality of data lines and a second region connected to a corresponding one of said plurality of pixel electrodes; and a gate line driver for sequentially applying a gate selection signal with a pulse-shaped voltage waveform to a selected one of said plurality of gate lines; wherein said gate line driver causes a falling edge of said gate selection signal with said pulse-shaped voltage waveform to be smoother than a rising edge thereof;

wherein, said gate line driver includes a gate buffer provided at a final stage and connected to a corresponding one of said plurality of gate lines, said gate buffer includes a transistor having first and second regions of an active layer respectively connected to the ground and to said corresponding gate line, and a channel length L and a channel width W of the transistor in said gate buffer satisfy the condition W/L<1; and said gate selection signal requires at least a time t/2 and shorter than t to fall, where t is the time from when a first gate line assumes an unselected state to when subsequent second gate line assumed a selected state.

5. An active matrix type display device comprising:

a plurality of gate lines;

a plurality of data lines crossing said plurality of gate lines;

a plurality of pixel electrodes;

a thin film transistor disposed at each intersection between said plurality of gate lines and said plurality of data lines, and including a gate electrode and an active region, said gate electrode being connected to one of said plurality of gate lines, and said active region having a first region connected to one of said plurality of data lines and a second region connected to a corresponding one of said plurality of pixel electrodes; and a gate line driver for sequentially applying a gate selection signal with a pulse-shaped voltage waveform to a selected one of said plurality of gate lines; wherein said gate line driver causes a falling edge of said gate selection signal with said pulse-shaped voltage waveform to be smoother than a rising edge thereof;

wherein, said gate line driver includes a gate buffer provided at a final stage and connected to a corresponding one of said plurality of gate lines, said gate buffer includes a current supplying transistor having first and second regions of an active layer connected between a power source and said corresponding gate line, and a current discharging transistor having first and second regions of an active layer respectively connected to the ground and to said corresponding gate line, and the ratio (channel width W)/(channel length L) of said current supplying transistor differs from the ratio (channel width W)/(channel length L) of said current discharging transistor; and said gate selection signal requires at least a time t/2 and shorter than t to fall, where t is the time from when a first gate line assumes an unselected state to when subsequent second gate line assumed a selected state.

6. An active matrix type display device comprising:

a plurality of gate lines;

a plurality of data lines crossing said plurality of gate lines;

a plurality of pixel electrodes;

a thin film transistor disposed at each intersection between said plurality of gate lines and said plurality of data lines, and including a gate electrode and an active region, said gate electrode being connected to one of said plurality of gate lines, and said active region having a first region connected to one of said plurality of data lines and a second region connected to a corresponding one of said plurality of pixel electrodes; and a gate line driver for sequentially applying a gate selection signal with a pulse-shaped voltage waveform to a selected one of said plurality of gate lines; wherein said gate line driver causes a falling edge of said gate selection signal with said pulsed-voltage waveform to be smoother than a rising edge thereof;

wherein, said gate line drive includes a gate buffer provided at a final stage and connected to a corresponding one of said plurality of gate lines, said gate buffer includes a current supplying transistor having first and second regions of an active layer connected between a power source and a corresponding gate line, and a current discharging transistor having a first and second regions of an active layer respectively connected to the ground and to said corresponding gate line, the ratio (channel width W) / (channel length L) of said current supplying the condition, $2.5(R1+R2)*(C1+C2)<t<5(R1+R2)*(C1+C2)$ is satisfied wherein R1 represents a total resistance of said gate line and the gate electrodes of the thin film transistors connected to said gate line in a pixel region, C1 represents a total capacitance of capacitors connected to said gate line in the pixel region and having said gate line as one electrode, R2 represents a channel resistance of the current discharging transistor in said gate buffer, C2 represents a capacitance of a capacitor formed by said active layer of the current discharging transistor in said gate buffer and the gate electrode thereof, and t represents a flyback period in a horizontal scanning period.

7. The active matrix type display device according to claim 6, wherein the channel length L and the channel width W of the current discharging transistor in said gate buffer satisfy the condition W/L<1.

8. The active matrix type display device according to claim 6, wherein the condition that the ratio of (the ratio W/L of said current supplying transistor)/(the ratio W/L of said current discharging transistor) is greater than 1 is satisfied.

9. The active matrix type display device according to claim 6, wherein the condition that the ratio of (the ration W/L of said current supplying transistor)/(the ratio of said current discharging transistor) is greater than 5 is satisfied.

10. An active matrix type display device comprising:

a plurality of gate lines;

a plurality of data lines crossing said plurality of gate lines;

a plurality of pixel electrodes;

a thin film transistor disposed at each intersection between said plurality of gate lines and said plurality of data lines, and including a gate electrode and an active region, said gate electrode being connected to one of said plurality of gate lines, and said active region having a first region connected to one of said plurality of data lines and a second region connected to a corresponding one of said plurality of pixel electrodes; and a gate line driver for sequentially applying a gate selection signal with a pulse-shaped voltage waveform to a selected one of said plurality of gate lines; wherein said gate line driver causes a falling time of said gate selecting signal to be longer than a rising time thereof;

wherein said gate selection signal requires at least a time t/2 and shorter than t to fall, where t is a time from when a first gate line assumes an unselected state to when a subsequent second gate line assumes a selected state.

11. An active matrix type display device comprising:

a plurality of gate lines;

a plurality of data lines crossing said plurality of gate lines;

a plurality of pixel electrodes;

a thin film transistor disposed at each intersection between said plurality of gate lines and said plurality of data lines, and including a gate electrode and an active region, said gate electrode being connected to one of said plurality of gate lines; and said active region having a first region connected to one of said plurality of data lines and a second region connected to a corresponding one of said plurality of pixel electrodes; and a gate line driver for sequentially applying a gate selection signal with a pulse-shaped voltage waveform to a selected one of said plurality of gate lines; wherein said gate line driver causes a falling time of said gate selection signal to be longer than a rising time thereof;

wherein said gate line driver includes a gate buffer provided at a final stage and connected to a corresponding one of said plurality of gate lines, said gate buffer includes a transistor having first and second regions of an active layer respectively connected to the ground and to said corresponding gate line, and the condition, $2.5(R1+R2)*(C1+C2)<t<5(R1+R2)*(C1+C2)$, is satisfied, wherein R1 represents a total resistance of said gate line and the gate electrodes of the thin film transistors connected to said gate line in a pixel region, C1 represents a total capacitance of capacitors connected to said gate line in the pixel region and having said gate line as one electrode, R2 represents a channel resistance of the transistor in said gate buffer, C2 represents a capacitance of a capacitor formed by said active layer of the transistor in said gate buffer and the gate electrode of said transistor, and t represents a flyback period in a horizontal scanning period.

12. The active matrix type display device according to claim 11, wherein a channel length L and a channel width W of the transistor in said gate buffer satisfy the condition $W/L<1$.

13. An active matrix type display device comprising:

a plurality of gate lines;

a plurality of data lines crossing said plurality of gate lines;

a plurality of pixel electrodes;

a thin film transistor disposed at each intersection between said plurality of gate lines and said plurality of data lines, and including a gate electrode and an active region, said gate electrode being connected to one of said plurality of gate lines, and said active region having a first region connected to one of said plurality of data lines and a second region connected to a corresponding one of said plurality of pixel electrodes; and a gate line driver for sequentially applying a gate selection signal with a pulse-shaped voltage waveform to a selected one of said plurality of gate lines; wherein said gate line driver causes a falling time of said gate selection signal to be longer than a rising time thereof;

wherein, said gate line driver includes a gate buffer provided at a final stage and connected to a corresponding one of said plurality of gate lines, said gate buffer includes a transistor having first and second regions of an active layer respectively connected to the ground and to said corresponding gate line, and a channel length L and a channel width W of the transistor in said gate buffer satisfy the condition $W/L<1$, and said gate selection signal requires at least a time t/2 and shorter than t to fall, where t is the time from when a first gate line assumes an unselected state to when subsequent second gate line assumed a selected state.

14. An active matrix type display device comprising:

a plurality of gate lines;

a plurality of data lines crossing said plurality of gate lines;

a plurality of pixel electrodes;

a thin film transistor disposed at each intersection between said plurality of gate lines and said plurality of data lines, and including a gate electrode and an active region, said gate electrode being connected to one of said plurality of gate lines, and said active region having a first region connected to one of said plurality of data lines and a second region connected to a corresponding one of said plurality of pixel electrodes; and a gate line driver for sequentially applying a gate selection signal with a pulse-shaped voltage waveform to a selected one of said plurality of gate lines; wherein said gate line driver causes a falling time of said gate selection signal to be longer than a rising time thereof;

wherein, said gate line driver included a gate buffer provided at a final stage and connected to a corresponding one of said plurality of gate lines, said gate buffer includes a current supplying transistor having first and second regions of an active layer connected between a power source and said corresponding gate line, and a current discharging transistor having first and second regions of an active layer respectively connected to the ground and to said corresponding gate line, the ratio (channel width W)/(channel length L) of said current supplying transistor differs from the ratio (channel width W)/(channel length L) of said current discharging transistor, and wherein said gate selection signal requires at least a time t/2 and shorter than t to fall, where t is the time from when a first gate line assumes an unselected state to when subsequent second gate line assumed a selected state.

15. The active matrix type display device according to claim 14, wherein the channel length L and the channel W of the current discharging transistor in said gate buffer satisfy the condition $W/L<1$..

16. The active matrix type display device according to claim 14, wherein the condition that the ratio of (the ratio W/L of said current supplying transistor)/(the ratio W/L of said current discharging transistor) is greater than 1 is satisfied.

17. The active matrix type display device according to claim 14, wherein the condition that the ratio of (the ratio W/L of said current supplying transistor)/ (the ratio W/L of said current discharging transistor) is greater than 5 is satisfied.

18. An Active matrix type display device comprising:

a plurality of gate lines;

a plurality of data lines crossing said plurality of gate lines;

a plurality of pixel electrodes;

a thin film transistor disposed at each intersection between said plurality of gate lines and said plurality of data lines, and including a gate electrode and an active region, said gate electrode being connected to one of said plurality of gate lines and said active region having a first retion connected to one of said plurality of data lines and a second region connected to a corresponding one of said plurality of pixel electrodes; and a gate line driver for sequentially applying a gate selection signal with a pulse- shaped voltage waveform to a selected one of said plurality of gate lines; wherein said gate line driver causes a falling time of said gate selection signal to be longer than a rising time thereof;

wherein, said gate line driver included a gate buffer provided at a final stage and a connected to a corresponding one of plurality of gate lines, said gate buffer includes a current supplying transistor having a first and second regions of an active layer connected between a power source and said corresponding gate line, and a current discharging transistor having first and second regions of an active layer respectively connected to the ground and to said corresponding gate line, the ratio (channel width W)/ (channel length L) of said current supplying transistor differs from the ratio (channel width W) (channel length L) of said current discharging transistor, and the condition, $2.5(R1+R2) * (C2) < t < 2$, is satisfied wherein R1represents a total resistance of said gate line and the gate electrodes of the thin film transistor connected to said gate line in a pixel region, C1represents a local capacitance of capacitors connected to said gate line in the pixel region and having said gate line as one electrode, R2represents a channel resistance of the current discharging transistor in said gate buffer, C2represents a capacitance of a capacitor formed by said active layer of the current discharging transistor in said gate buffer and the gate electrode thereof, and t represents a flyback period in a horizontal scanning period.

* * * * *